US008900022B2

(12) United States Patent
Clark

(10) Patent No.: US 8,900,022 B2
(45) Date of Patent: Dec. 2, 2014

(54) APPARATUS FOR USE WITH AND/OR AS PART OF A FLOATABLE ITEM

(76) Inventor: Bryan Clark, Truro (GB)

( * ) Notice: Subject to any disclaimer, the term of this patent is extended or adjusted under 35 U.S.C. 154(b) by 91 days.

(21) Appl. No.: 13/605,727

(22) Filed: Sep. 6, 2012

(65) Prior Publication Data

US 2013/0059490 A1 Mar. 7, 2013

(30) Foreign Application Priority Data

Sep. 6, 2011 (GB) ..... 1115325.1

(51) Int. Cl.

| | |
|---|---|
| ***B63H 5/16*** | (2006.01) |
| ***F03B 13/00*** | (2006.01) |
| ***B63H 25/52*** | (2006.01) |
| ***B63B 35/79*** | (2006.01) |

(52) U.S. Cl.

CPC ..... *F03B 13/00* (2013.01); *B63H 25/52* (2013.01); *B63B 35/7926* (2013.01)

USPC ..... 440/69; 114/288; 441/65; 441/74

(58) Field of Classification Search

USPC ..... 114/148, 151, 288, 289, 290; 440/6, 68, 440/69; 441/65, 74

See application file for complete search history.

(56) References Cited

U.S. PATENT DOCUMENTS

| | | | | |
|---|---|---|---|---|
| 2,330,674 | A * | 9/1943 | Briggs | 114/151 |
| 3,933,113 | A * | 1/1976 | Dornak, Jr. | 114/151 |
| 4,756,698 | A * | 7/1988 | Gorg | 114/151 |
| 6,482,054 | B2 * | 11/2002 | Treaster et al. | 114/151 |
| 8,070,544 | B2 * | 12/2011 | Roman | 441/74 |

* cited by examiner

*Primary Examiner* — Lars A Olson

(74) *Attorney, Agent, or Firm* — McKee, Voorhees & Sease

(57) ABSTRACT

There is provided an item which floats in a body of water. The item includes a body having a surface provided to form at least part of the underside of the item and an opposing surface. The item includes apparatus comprising at least one channel which passes between the surfaces and allows the passage of water therethrough. A means provided to influence and/or be influenced by the passage of the water through the at least one channel to exert a propelling and/or controlling force on the item.

21 Claims, 2 Drawing Sheets

APPARATUS FOR USE WITH AND/OR AS PART OF A FLOATABLE ITEM

CROSS-REFERENCE TO RELATED APPLICATIONS

This is a application claims priority to GB 1115325.1 filed Sep. 6, 2011, which is hereby incorporated by reference in its entirety.

FIELD OF THE INVENTION

The invention which is the subject of this application relates to apparatus for use in increasing the speed and/or enhancing the dynamic performance of a floatable item such as, but not necessarily exclusively, a surfboard or another floating vehicle. The apparatus is typically operated in a manner to harness the kinetic energy extant on the face of a wave in the body of water in which the item is positioned at that time. By doing so the apparatus causes the item to travel faster in a straight line and/or during manoeuvres.

It should be noted that although reference hereonin is made to the use of an item in the form of a surfboard, this is done for the purpose of illustration and not in a limiting manner as to the scope of the invention.

BACKGROUND OF THE INVENTION

The objective of using an item on water such as a surfboard is to stand on a surfboard while it travels across the face of a breaking wave. However if insufficient speed can be achieved by the surfboard across the body of water or wave then in many instances the selected wave may travel faster than the board and can therefore not be "caught". Furthermore, a lack of speed can mean that certain manoeuvres cannot be successfully achieved. The lack of speed and manoeuvrability can therefore significantly limit the use of the item. Although devices are known to have been used in the past the same typically tend to be externally placed devices (such as fins). However fins tend to generate large amounts of drag which has the effect of slowing the craft. For example, a hydrofoil suffers from the problem that it is not until the speed through the water is quite high that the drag it creates drops away.

The aim of the present invention is therefore to provide apparatus which can add additional thrust when the item is moving in the body of water which can for example be arranged in the direction of travel and thus increase the speed of the surfboard. A further aim is that by increasing the speed of the board, more complex manoeuvres such as jumps and turns can be achieved and, in turn, make it easier to surf fast breaking waves which, otherwise, would be very difficult to surf along. It should also be noted that while the addition of speed is one of the significant benefits of the apparatus of the invention The aims of the use of the apparatus is not limited to adding speed to a surfboard and any floating craft which operates in water waves can benefit from this additional thrust, for example ocean going ships, sailing yachts and small boats.

SUMMARY OF THE INVENTION

In one aspect of the invention there is provided an item which floats in a body of water, said item including: a body, said body having a surface provided to form at least part of the underside of the item and an opposing surface, wherein said item includes apparatus comprising at least one channel which passes between the said surfaces and allows the passage of water therethrough, and a means provided to influence and/or be influenced by the passage of the water through said channel to exert a propelling and/or controlling force on the item.

In one embodiment the apparatus acts as a thrust unit for the item. In another embodiment in addition, or alternatively the apparatus is provided as part of a system with means to allow the thrust which is created to be provided in a selected direction. In one embodiment the said means is a servo-mechanism.

In one embodiment the apparatus is provided integrally with the item. In an alternative embodiment the apparatus is joined to the item.

In one embodiment the means which is provided to influence and/or be influenced by the passage of water is a substantially planar foil, which is typically provided to generate a lift effect on the item. In addition or alternatively the said means influenced by the passage of the water is a turbine which is used to generate rotational torque. In a yet further embodiment the said means influenced by the passage of the water is an electromagnetic device such as a coil of wire and magnets to generate electricity.

In one embodiment the apparatus operates successfully when the item is moving along and/or in conjunction with a wave in the body of water. The apparatus relies on the natural phenomenon that as a water wave passes through a body of water, the water particles on the face of the wave are constantly rushing up the face of the wave. The kinetic energy in this moving water is harnessed for use by directing this flow of water through the channel.

In one embodiment the item is a surfboard.

In one embodiment the means provided to influence and/or be influenced by the body of water is provided in a selected positional relationship with the at least one channel.

In one embodiment the shape of the at least one channel and/or means can be selected to provide specific characteristics of the item. Furthermore the position of the at least one channel and/or means on the body can be selected to provide particular movement effects on the board.

In one embodiment there may be provided a plurality of means to be influenced by the passage of water in or adjacent to the said at least one channel.

In one embodiment at least one channel is created in an item in the form of a ship or boat near the stern of the same. In this embodiment as the ship sails in a swell travelling in the same direction as the ship, water is passed over a lifting surface or surfaces inside the channel to provide forward thrust which pushes the ship forward.

Typically the apparatus is located within the body of the item.

In a further aspect of the invention there is provided an item which can float on water and which includes the apparatus as herein described.

Thus by utilising the apparatus in accordance with this application the additional thrust produced by the apparatus of the invention makes it easier to catch the wave which is to be surfed on, with the increase in thrust enabling the surfboard to reach the planing speed sooner, thus enabling the surfer to stand-up earlier. This, in turn, increases the range of waves which can be surfed and the manoeuvres which can be attempted and enjoyed by the surfer.

BRIEF DESCRIPTION OF THE DRAWINGS

Specific embodiments of the invention are now described with reference to the accompanying drawings; wherein FIGS. 1*a* and *b* show views of one embodiment of apparatus in accordance with the invention.

DESCRIPTION OF THE INVENTION

Figure 1A:
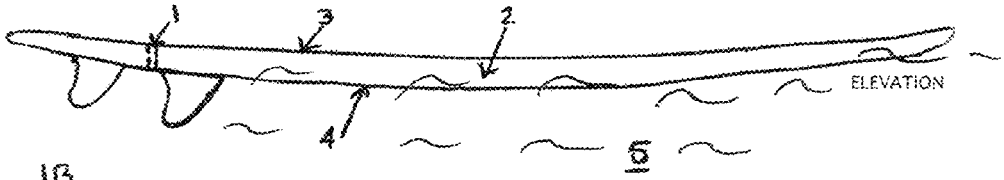
Figure 1B:
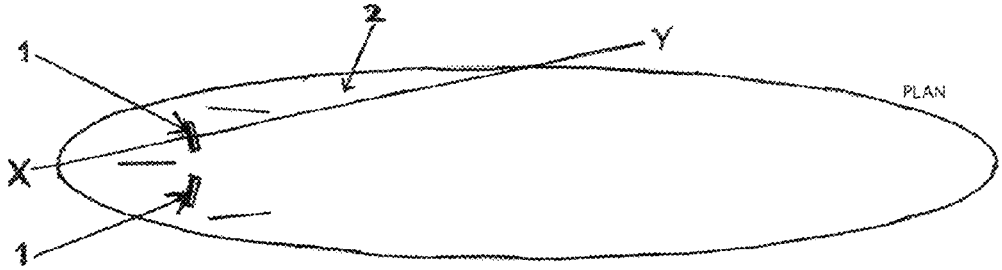
Figure 2:
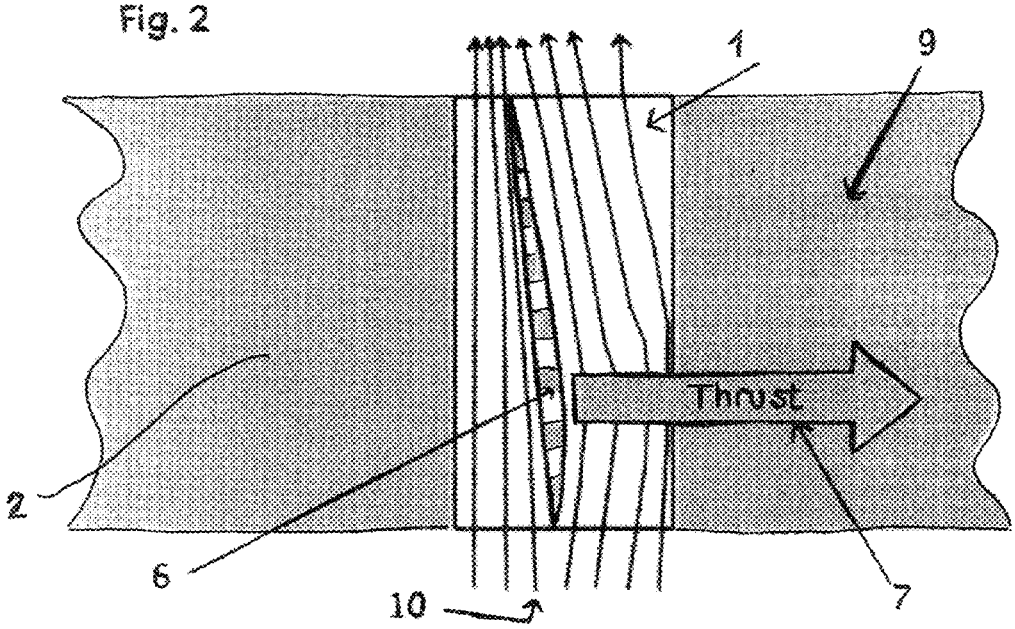
FIG. 2 shows a sectional view along line XY of FIG. 1*b*.

In the embodiment of the invention as now described with reference to FIGS. 1*a* and *b* there is shown, in plan and elevation, channels 1 in accordance with the invention which pass through an item in the form of a surfboard 2 from the deck surface 3 to the bottom surface 4 which is in contact with the body of water 5 as shown. A means 6 provided to influence and/or be influenced by the passage of the water through the channel 1 is shown in FIG. 2 and in this case the means 6 is in the form of a substantially planar foil. The foil 6 is provided as an elongate member disposed within or adjacent to the channel 1 and is movable with respect to the said channel 1. The shape and size of the foil 6 may be varied to produce different desired effects or different amounts of thrust. The foil 6 is fixed inside the channel 1 and arranged so that as the water rushes through the channel 1 it generates hydrodynamic lift which creates a force which pushes the surfboard 2 through the water. The section XY marked on FIG. 1 is shown in FIG. 2.

FIG. 2 shows the foil 6 used to generate hydrodynamic lift which translates into movement thrust 7. The channel 1 is set into the body 9 of the surfboard 2. Hydrodynamic flow is represented in FIG. 2 by a series of streamlines 10 which show the water on the face of the wave flowing through the channel 1.

The aperture and the orientation of the foil 6 can be chosen to enhance the dynamic characteristics of the surfboard in desired ways. In one embodiment the foil 6 is arranged to generate thrust aligned along the face to the wave and by so doing increase the forward speed of the surfboard 2. In another embodiment the foil 6 and the aperture could be arranged so that the forces generated create a heaving force which could be used to increase pitch stability when the rider is standing on the nose of the board 2.

It will be apparent that this invention can be embodied within designs to augment the dynamic characteristics on any item which operates within the environs of a body of water and particularly with regard to the face of a water wave. This is done by capturing the kinetic energy abundant in a water wave by directing the flowing water through the channel 1 and then passing this flowing water over a means such as a foil 6 to generate desired forces such as thrust. The channel 1 may be curved to direct the water at any desired angle relative to the item and the means positioned in the resultant flow—thus any combination of thrust, heave or yaw may be achieved and this in combination with the chosen position of the channel 1 on the item will result in desired forces acting on the item and result in enhanced dynamic characteristics of the craft as it floats or planes along the face of a water wave. Other desired forces that could be generated could be electricity or rotational motion.

Another feature of this apparatus is the benefit created by placing the apparatus inside the body of the surfboard 2 or other craft. This is especially important when considering planing vehicles such as surfboards. Because this apparatus is embedded within the body of the surfboard 2 or other craft, the flow of water at low speeds will flow in a laminar way past the intake of the channel. This is especially important in a surfboard where human power is used to accelerate the surfboard from rest and to gain sufficient speed to position it on the face of the wave so that gravity can then be used to create enough speed for the item to transition from being a displacement craft to becoming a planing craft. Reducing drag to a minimum during low speed motion as a displacement craft is very important and this is achieved by positioning the lifting surface inside the body of the craft. Furthermore, in the case of a surfboard, the apparatus generates useful forces as soon as it is placed on the face of a wave—and can be positioned to create additional forward motion, even before the surfboard starts to plane. By using this apparatus within a surfboard it enables the rider to gain sufficient speed under their own paddling power to catch very large waves that would otherwise be travelling too fast for them to catch.

The number of channels 1 provided may be as many as desired. Each aperture may be positioned in a desired location so that it produces desired forces when the craft is positioned in different orientations to the face of a water wave. For example, one or more channels 1 can be placed near the tail of the board 2 so that they generate thrust when the rider is standing on the tail of the board 2 and the tail of the board 2 is in the face of the wave. Others may be positioned so that they generate thrust when the sides or nose of the board 2 is in the face of the wave.

The shape of the channels 1 and/or means to influence and/or be influenced by the movement of the water may also be varied to produce different desired effects. For example the aperture may be curved and the lifting surface may also be curved so that different parts of the foil 6 produce different amounts of thrust depending on the orientation of the board in relation to the wave face. So for example a crescent moon shaped aperture could be placed near the tail of the board 2 to generate uniform thrust throughout a manoeuvre where the surfboard 2 is turned on its tail and thus generate extra speed in the surfboard 2 when making turns.

The number of said means within each channel 1 may also be varied to generate additional forces acting in one location on the craft. So for example, an aperture may have three of the said means arranged within it to generate additional lift.

The size of the channels 1 may also be varied, along with the size of the foils 6 in order to vary the size of the force created. The size may be chosen to generate forces proportional to the size and speed of the wave. So for example in large fast moving waves the size of the channel 1 and said means may be relatively smaller than one chosen to operate in smaller and relatively slower waves.

The shape of the lifting surface means may also be varied to achieve different amounts of lift as the water flows over it and also achieves different amounts of lift at different angles of attack relative to the flow of the water through the aperture.

The construction of the apparatus offers a number of design options. In one embodiment the channel 1 may be simply a hole cut through a surfboard and the said means fixed in place using a polyester resin and the inside of the aperture made water-tight using a lamination made of fibre-glass and polyester resin. Other resins and laminate materials could also be used as an alternative.

In another embodiment of the apparatus the channel 1 may be pre-fabricated as a unit made from any desired material, for example plastic. The means to be influenced by the flow of water can be built into the apparatus with or without adjustments to allow the angle of attack of the said means to be varied. The means, when in the form of foils 6, can be made so they are detachable so that they can be replaced with different shaped foils 6 to produce different lifting properties dependant on different surfing conditions. The pre-fabricated unit can then be added to any surfboard by simply cutting a hole in it and fitting the apparatus. If it is made slightly bigger than a typical surfboard thickness then the apparatus's top and bottom edges may be ground down after fitting so that the deck and the bottom of the surfboard are flush with the top and the bottom of the apparatus.

It will be apparent that this invention offers multiple options in its detailed embodiment that can be selected to enhance as desired the dynamic performance of any craft operating in the face of a water wave.

In another embodiment of the apparatus a channel is created in a large ocean going ship near the stern of the ship. As the ship sails though ocean swell travelling in the same direction as the ship water is passed over a lifting surface or surfaces inside the aperture. This results in forward thrust which pushes the ship forward. This will reduce the fuel consumption of the ship significantly.

What is claimed is:

1. An item which floats on a body of water, said item including:

a buoyant body, said body having a lower surface provided to form at least part of the underside of the item and an opposing upper surface, wherein said item includes apparatus comprising at least one channel which passes between the said lower and upper surfaces and allows the passage of water therethrough, means provided to influence and/or be influenced by the passage of the water through said channel to exert a propelling force on the item;

wherein the means that is provided to influence and/or be influenced by the passage of water is an electromagnetic device; and wherein the electromagnetic device is a coil of wire and magnets.

2. An item according to claim 1, wherein the apparatus acts as a thrust unit for the item.

3. An item according to claim 1, wherein the apparatus includes means to allow the thrust which is created to be provided in a selected direction.

4. An item according to claim 3, wherein the said means is a servomechanism.

5. An item according to claim 1, wherein the apparatus is provided integrally with the item.

6. An item according to claim 1, wherein the apparatus is attached to the item.

7. An item according to claim 1, wherein the item is a surfboard.

8. An item according to claim 1, wherein the means that influences and/or is influenced by the water is provided in a selected positional relationship with the at least one channel.

9. An item according to claim 1, wherein the shape and respective positions of the at least one channel and/or means is selected to provide control of the movement of the item through and across the body of water.

10. An item according to claim 1 wherein a plurality of means to be influenced by the passage of water are provided in or adjacent to the said at least one channel.

11. An item according to claim 1, wherein the at least one channel is created in the body substantially at the rear of the same with respect to the direction of movement of the item.

12. An item according to claim 1, wherein the apparatus is located within the body of the item.

13. An item according to claim 1 wherein the means which are influenced by the movement of water can be selectively fitted in conjunction with the one or more channels.

14. An item according to claim 13 wherein the said means which are fitted are selected from a range of means of different size and shape and are selected with reference to the condition of the body of water in which the item is to be used at that time.

15. A floating device for use on water, comprising:

a buoyant body having a lower surface adapted to engage the water's surface and an upper surface adapted to be spaced, at least in part, above the water surface;

a channel extending through the body between the upper and lower surfaces such that water flows upwardly through the channel;

a foil within the channel to create hydrodynamic lift on the flow of water through the channel and thereby create thrust in a forward direction to propel the body relative to the water's surface.

16. The floating device of claim 15 wherein the body is a surfboard.

17. The floating device of claim 15 wherein the body has opposite forward and rearward ends, and the channel is formed towards the rearward end of the body.

18. The floating device of claim 15 wherein the foil extends substantially axially within the channel.

19. The floating device of claim 15 wherein the channel extends substantially perpendicular to the thrust direction.

20. The floating device of claim 15 wherein more than one foil may be located within the channel.

21. The floating device of claim 15 wherein one or more channels may be provided, each having one or more foils located therein.

* * * * *